US011450256B2

(12) United States Patent
Wang

(10) Patent No.: US 11,450,256 B2
(45) Date of Patent: Sep. 20, 2022

(54) SIGNAL ADJUSTING CIRCUIT AND METHOD AND DISPLAY DEVICE

(71) Applicant: HKC CORPORATION LIMITED, Shenzhen (CN)

(72) Inventor: Mingliang Wang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/257,009

(22) PCT Filed: Dec. 13, 2018

(86) PCT No.: PCT/CN2018/120863

§ 371 (c)(1),
(2) Date: Dec. 30, 2020

(87) PCT Pub. No.: WO2020/087674

PCT Pub. Date: May 7, 2020

(65) Prior Publication Data

US 2021/0280114 A1 Sep. 9, 2021

(30) Foreign Application Priority Data

Oct. 30, 2018 (CN) ..... 201811278582.4

(51) Int. Cl.
*G09G 3/20* (2006.01)

(52) U.S. Cl.
CPC ..... *G09G 3/20* (2013.01); *G09G 2310/08* (2013.01); *G09G 2330/06* (2013.01); *G09G 2370/00* (2013.01)

(58) Field of Classification Search
CPC ..... G09G 2310/08; G09G 2330/06; G09G 2370/00; G09G 3/20
See application file for complete search history.

(56) References Cited

U.S. PATENT DOCUMENTS

2003/0161394 A1* 8/2003 Shi ..... H04L 25/03006 375/229
2011/0043512 A1* 2/2011 Ooga ..... G09G 3/3688 345/212
2015/0097878 A1 4/2015 Yamashita et al.

FOREIGN PATENT DOCUMENTS

CN 101996556 A 3/2011
CN 105810139 A 7/2016
(Continued)

OTHER PUBLICATIONS

Tingting Ma, the International Searching Authority written comments, dated Aug. 2019, CN.
(Continued)

*Primary Examiner* — Ram A Mistry

(57) ABSTRACT

A signal adjusting circuit includes an identification circuit, an analysis circuit and an adjusting circuit; where the identification circuit is configured to acquire row data to be transmitted and identify the type of each data; the analysis circuit is connected with the identification circuit and is configured to analyze the data type of the row data according to the type of each data and output an adjusting instruction when the row data type meets or exceeds a preset data type criterion; the adjusting circuit is connected with the analysis circuit and is configured to adjust the transmission amplitude of the output data signal according to the adjusting instruction.

17 Claims, 3 Drawing Sheets

(56) References Cited

FOREIGN PATENT DOCUMENTS

| | | | |
|---|---|---|---|
| CN | 106098017 | A | 11/2016 |
| CN | 106128406 | A | 11/2016 |
| CN | 107301841 | A | 10/2017 |
| CN | 108630159 | A | 10/2018 |

OTHER PUBLICATIONS

Tingting Ma, the International Search Report, dated Aug. 2019, CN.

* cited by examiner

SIGNAL ADJUSTING CIRCUIT AND METHOD AND DISPLAY DEVICE

CROSS REFERENCE OF RELATED APPLICATIONS

This application claims the priority to the Chinese Patent Application No. 201811278582.4, filed with National Intellectual Property Administration, PRC on, Oct. 30, 2018 and entitled "SIGNAL ADJUSTING CIRCUIT AND METHOD AND DISPLAY DEVICE", which is incorporated herein by reference in its entirety.

TECHNICAL FIELD

The present application relates to a signal adjusting circuit and method and a display device.

BACKGROUND

The statements herein merely provide background information related to the present application and may not necessarily constitute related art.

With the increasing size and resolution of Liquid Crystal Display (LCD) TV, the data to be transmitted is increasing, so that the differential signal is popularized as a high-speed transmission protocol, the quality of data transmission is also subject to more challenges, and only when the voltage amplitude (the voltage amplitude corresponds to the high level and the low level of the data) meets the requirement can the data be stored in the register to make the data transmission accurate.

However, the increase of the number of differential pairs and the fact that the driving board becomes thinner, plus the increase of transmitted data and the complexity and changeability of the amplitude of actually received data due to the constant change of transmitted data make the amplitude of data transmission worse and worse, thus requiring a lot of time to carefully debug in practical application to ensure the differential transmission of each pair, which is time-consuming and labor-consuming. Also, since the transmitted data remain varying, it is impossible to ensure that each data is received accurately. Alternatively, a larger transmission amplitude may be directly set at the timing control end, however, this may often cause an excessive Electromagnetic Interference (EMI) radiation.

SUMMARY

According to various embodiments disclosed in the present application, a signal adjusting circuit and method and a display device are provided.

A signal adjusting circuit, including:

an identification circuit configured to acquire row data to be transmitted and identify the type of each data;

an analysis circuit connected with the identification circuit and configured to analyze the data type of the row data according to the type of each data, and output an adjusting instruction when the row data type meets or exceeds a preset data type criterion; and an adjusting circuit connected with the analysis circuit and configured to adjust the transmission amplitude of the output data signal according to the adjusting instruction.

In one or more embodiments, the identification circuit includes:

a storage device connected with the analysis circuit and configured to acquire row data of the transmission and store or output the row data; and a counting device connected with the storage device and the analysis circuit and configured to count each data in the row data and identify the type of each data.

In one or more embodiments, the storage device includes a row memory.

In one or more embodiments, the counting device includes a column counter.

In one or more embodiments, the analysis circuit includes:

an analysis device connected with the identification circuit and configured to analyze the row data type according to the type of each data; and a comparison device connected with the analysis device and configured to compare the row data type with the preset data type criterion, and generate an adjusting instruction when the row data type meets or exceeds the preset data type criterion.

In one or more embodiments, the adjusting circuit includes:

a current adjusting device connected with the analysis circuit and configured to adjust an output current according to the adjusting instruction.

In one or more embodiments, the current adjusting device is a current source.

In one or more embodiments, the row data is pixel data.

In one or more embodiments, the data type includes 0 and 1, where the 0 represents a negative level and the 1 represents a positive level.

In one or more embodiments, the preset data type criterion includes a forward preset data type criterion and a reverse preset data type criterion.

In one or more embodiments, the preset data type criterion is set according to a switching frequency of a data type.

A display device including a display panel and a signal adjusting circuit connected with the display panel;

The signal adjusting circuit includes:

an identification circuit configured to acquire row data to be transmitted and identify the type of each data;

an analysis circuit connected with the identification circuit and configured to analyze the data type of the row data according to the type of each data, and output an adjusting instruction when the row data type meets or exceeds a preset data type criterion; and an adjusting circuit connected with the analysis circuit and configured to adjust the transmission amplitude of the output data signal according to the adjusting instruction.

A signal adjusting method includes the steps of:

acquiring row data to be transmitted and identifying the type of each data;

analyzing the data type of the row data according to the type of each data, and outputting an adjusting instruction when the row data type meets or exceeds the preset data type criterion; and adjusting the transmission amplitude of the output data signal according to the adjusting instruction.

In one or more embodiments, the step of acquiring row data to be transmitted and identifying the type of each data includes:

acquiring row data to be transmitted and storing or outputting the row data; and counting each data in the row data and identifying the type of each data.

In one or more embodiments, the step of analyzing the data type of the row data according to the type of each data and outputting an adjusting instruction when the data type meets or exceeds the preset data type criterion includes:

analyzing the row data type according to the type of each data; and comparing the row data type with the preset data type criterion, and generate an adjusting instruction when the row data type meets or exceeds the preset data type criterion.

In one or more embodiments, before the step of analyzing the data type of the row data according to the type of each data and outputting an adjusting instruction when the data type meets or exceeds the preset data type criterion, the method includes:

presetting the data type criterion.

In one or more embodiments, the step of adjusting the transmission amplitude of the output data signal according to the adjusting instruction specifically includes:

adjusting an output current according to the adjusting instruction.

The details of one or more embodiments of the present application are set forth in the accompanying drawings and the description below. Other features and advantages of the present application will be apparent with respect to the description, drawings, and the claims.

BRIEF DESCRIPTION OF DRAWINGS

In order to more clearly illustrate the technical solutions of the embodiments of the present application, the drawings required in the description of the embodiments will be briefly described below. Obviously, the drawings in the following description are merely some embodiments of the present application, and those of ordinary skill in the art can acquire other drawings according to the drawings without any inventive labor.

DETAILED DESCRIPTION OF EMBODIMENTS

In order to make the technical solutions and advantages of the present application more clearly understood, the present application is further described in detail below with reference to the accompanying drawings and embodiments. It should be understood that the specific embodiments described herein are only for explaining, but not for limiting the present application.

Figure 1:
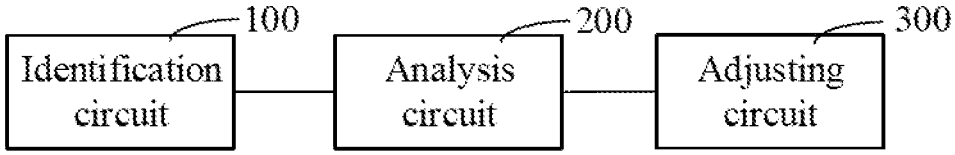
FIG. 1 is a structural diagram of a signal adjusting circuit according to an embodiment.

Referring to FIG. 1, which is a structural diagram of a signal adjusting circuit according to an embodiment.

In the present embodiment, the signal adjusting circuit includes: an identification circuit 100, an analysis circuit 200 and an adjusting circuit 300. In the present embodiment, the identification circuit 100, the analysis circuit 200 and the adjustment circuit 300 are arranged at a sending end of a data transmission. In one or more embodiments, the identification circuit 100, the analysis circuit 200, and the adjusting circuit 300 of the signal adjusting circuit are arranged in a timing controller.

The identification circuit 100 is configured to acquire row data to be transmitted and identify the type of each data.

The analysis circuit 200 connected with the identification circuit 100 is configured to analyze the data type of the row data according to the type of each data, and output an adjusting instruction when the row data type meets or exceeds the preset data type criterion.

And the adjusting circuit 300 connected with the analysis circuit 200 is configured to adjust the transmission amplitude of the output data signal according to the adjusting instruction.

In the present embodiment, the identification circuit 100 is connected with the analysis circuit 200, and is configured to acquire and store the row data to be transmitted, identify the type of each data, and output the data and the type of each data to the analysis circuit 200 when the data needs to be transmitted. In the present embodiment, the row data refers to data of a row in the horizontal direction, specifically to pixel data, each of which has a corresponding data type. In one or more embodiments, the data types can embody the level of the pixel data, and the specific data types include 0 and 1, where the 0 represents a negative level and the 1 represents a positive level. For example, the data type of the first pixel data is 0, the data type of the second pixel data is 0, and the data type of the third pixel data is 1.

In the present embodiment, the analysis circuit 200 is connected with the identification circuit 100, and is configured to analyze the row data type according to the type of each data, compare the acquired row data type with the preset data type criterion, and generate an adjusting instruction when the row data type meets or exceeds the preset data type criterion, so as to control the adjusting circuit to adjust the transmission amplitude of the output data signal.

In the present embodiment, the analysis circuit 200 may acquire the row data type by sorting and integrating the type of each data, and analyzing the data type segments with relatively regular rules. For example, by sorting and integrating the type of each data, the row data type of 01010101 is acquired.

In the present embodiment, the preset data type criterion is a criterion established in advance, and when a differential data pair is transmitted, the preset data type criterion is divided into a forward preset data type criterion and a reverse preset data type criterion, which corresponds to each other, for example, if the forward preset data type criterion is 11101110, the reverse preset data type criterion is 00010001. The preset data type criterion may be set according to an actual data transmission, and specifically to a switching frequency of a data type, for example, a frequency degree of switching between 0 and 1. For example, the amplitude is relatively low when the data type is suddenly switched to 1 after a plurality of consecutive 0s, or the amplitude is relatively low when the data type is suddenly switched to 0 after a plurality of consecutive 1s, so that the data type that is suddenly switched to 1 after a plurality of consecutive 0s or that is switched to 0 after a plurality of is may be set as the preset data type criterion, for example, 0000100001 is set as the preset data type criterion. The setting of the number of "a plurality" specifically needs to consider the actual data transmission condition as well as the data transmission quality and EMI effect desired by the user.

Figure 2:
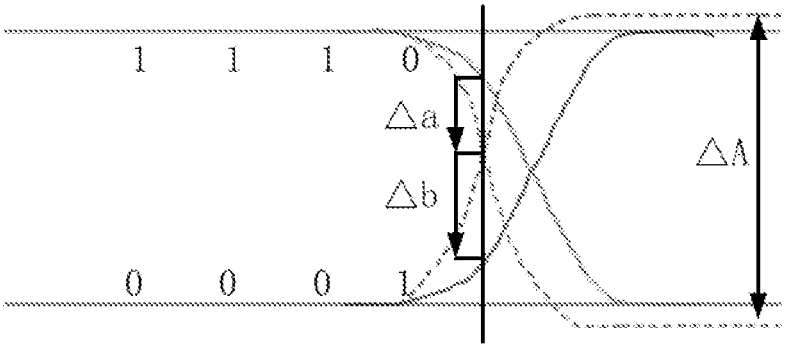
FIG. 2 is a diagram of transmission of a differential pair of data.

In the present embodiment, the adjusting circuit 300 is connected with the analysis circuit 200, and is configured to adjust the transmission amplitude of the output data signal according to the adjusting instruction, so that the transmission amplitude of each data meets the criterion, the switching speed of the data is increased, and the amplitude is not set to be too large, thus ensuring the optimal EMI radiation effect of each data; when a plurality of data are not continuously switched, the data can be transmitted by using a lower amplitude, which ensures that the EMI radiation will not exceed the criterion; meanwhile, the automatic adjustment requires less manual intervention in debugging, thereby saving time and labor. For example, referring to FIG. 2, which is a diagram of transmission of a differential pair of data, in which the solid line portion is a waveform before amplitude adjustment, and the dashed line portion is a waveform after amplitude adjustment, where the forward preset data type criterion is 11101110, and when the row data type of data transmission of curve a happens to be 11101110, the analysis circuit 200 will generate an adjusting instruction and the adjusting circuit 300 will adjust the transmission amplitude according to the adjustment instruction, such that the transmission amplitude is increased by Δa and the data switching speed is increased; correspondingly, the reverse preset data type criterion is 00010001, when the row data type of data transmission of curve b is 00010001, the analysis circuit 200 will generate an adjustment instruction, and the adjustment circuit 300 will adjust the transmission amplitude according to the adjustment instruction, so that the transmission amplitude is increased by Δb and the data switching speed is increased, and the final amplitude of differential pair transmission is changed into ΔA. The adjusting circuit 300 may directly adjust the transmission amplitude, or may otherwise indirectly adjust the transmission amplitude.

The signal adjusting circuit provided by the present embodiment includes an identification circuit 100, an analysis circuit 200 and an adjusting circuit 300, in which the type of each data is identified through the identifying circuit 100, the analysis circuit 200 analyzes the row data type according to the type of each data, and outputs an adjusting instruction when the row data type meets or exceeds a preset data type criterion, causing the adjusting circuit 300 to dynamically adjust the transmission amplitude of the output data signal according to the adjusting instruction, so that the transmission amplitude of each data meets the criterion, the switching speed of the data is increased, and the amplitude is not set to be too large, thus ensuring the optimal EMI radiation effect of each data; when a plurality of data are not continuously switched, the data can be transmitted by using a lower amplitude, which ensures that the EMI radiation will not exceed the criterion; meanwhile, the automatic adjustment requires less manual intervention in debugging, thereby saving time and labor.

Figure 3:
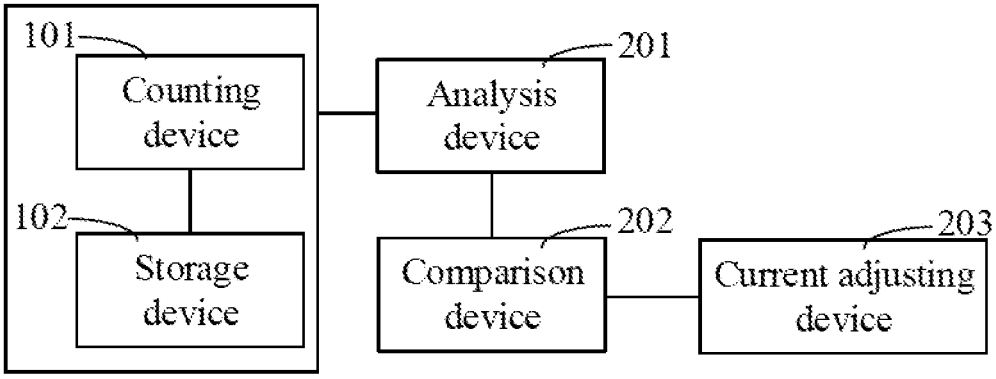
FIG. 3 is a structural diagram of one of the embodiments corresponding to signal adjusting circuit of FIG. 1.

Referring to FIG. 3, which is a structural diagram of one of the embodiments of the signal adjusting circuit of FIG. 1.

In the present embodiment, the identification circuit 100 includes a storage device 101 and a counting device 102.

The storage device 101 is connected with the analysis circuit 200 and configured to acquire row data to be transmitted and store or output the row data. Specifically, the storage device 101 acquires and stores the row data to be transmitted, and outputs the data and the type of each data to the analysis circuit 200 when the data needs to be transmitted. The storage device 101 may be a row memory.

The counting device 102 is connected with the storage device 101 and the analysis circuit 200, and is configured to count each data in the row data and identify the type of each data. The counting device 102 may be a column counter.

In the present embodiment, the analysis circuit 200 includes an analysis device 201 and a comparison device 202.

The analysis device 201 is connected with the identification circuit 100 and is configured to analyze the row data type according to the type of each data. Specifically, the analysis device 201 may acquire the row data type by sorting and integrating the type of each data, and analyzing the data type segments with relatively regular rules.

The comparison device 202 is connected with the analysis device 201, and is configured to compare the row data type with the preset data type criterion, and generate an adjusting instruction when the row data type meets or exceeds the preset data type criterion. Specifically, the comparison device 202 may establish a preset data type criterion, compare the data type criterion with the preset data type criterion after acquiring the row data type, generate an adjusting instruction when the row data type meets or exceeds the preset data type criterion, and feed back the adjusting instruction to the adjusting circuit 300; no adjusting instruction is generated when the row data type is lower than the preset data type criterion, and the amplitude does not need to be adjusted.

In the present embodiment, the adjusting circuit 300 includes a current adjusting device 301. The current adjusting device 301 is connected with the analysis circuit 200, and is configured to adjust an output current according to the adjusting instruction, thereby realizing adjustment of the output amplitude. Specifically, the current adjusting device 301 is a current source, and the output amplitude is increased by controlling the magnitude of the current, so that the switching speed of transmission between the data of the differential pair is increased, and thus the larger the amplitude of data rising in the same time is, the smaller the reverse amplitude is, the transmission amplitude of each data meets the criterion, and the amplitude is not set to be too large, thereby ensuring the optimal EMI radiation effect of each data. In addition to meeting the amplitude requirement of data transmission, when a plurality of data are not continuously switched, the data can be transmitted by using a lower amplitude, which ensures that the EMI radiation will not exceed the criterion.

The signal adjusting circuit provided by the present embodiment identifies the type of each data through the counting device 102, analyzes the row data type according to the type of each data though the analysis device 201, and generates an adjusting instruction when the row data type meets or exceeds a preset data type criterion through the comparison device 202, causing the current adjusting device 301 to dynamically adjust the output current according to the adjusting instruction, thereby realizing the adjustment of the transmission amplitude of an output data signal, so that the transmission amplitude of each data meets the criterion, and the amplitude is not set to be too large, thus ensuring the optimal EMI radiation effect of each data; when a plurality of data are not continuously switched, the data can be transmitted by using a lower amplitude, which ensures that the EMI radiation will not exceed the criterion; meanwhile, the automatic adjustment requires less manual intervention in debugging, thereby saving time and labor.

The present embodiment provides a display device including a display panel and the signal adjusting circuit described in the above embodiments. Specifically, the display driving circuit on the display panel is connected with the signal adjusting circuit, and by adjusting the transmission amplitude of the data signal by the signal adjusting circuit, it is possible to ensure that each data displayed is correctly received by the display driving circuit, thus improving the display reliability of the display panel.

The display panel of the present embodiment may be any of the following: Liquid Crystal display panels, OLED display panels, QLED display panels, Twisted Nematic (TN) or Super Twisted Nematic (STN) type, In-Plane Switching (IPS) type, Vertical Alignment (VA) type, curved panel, or other display panels.

Figure 4:
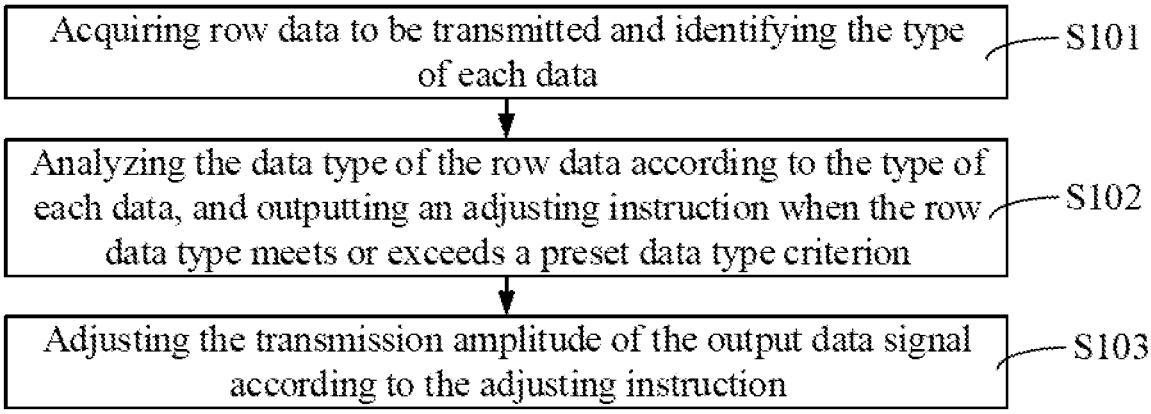
FIG. 4 is a flowchart of a method corresponding to the signal adjusting circuit of FIG. 1 according to an embodiment.

Referring to FIG. 4, which is a flowchart of a method corresponding to the signal adjusting circuit of FIG. 1 according to an embodiment.

In the present embodiment, the signal adjusting method includes steps S101, S102, and S103. The details are as follows:

In step S101, row data to be transmitted is acquired, and the type of each data is identified.

In the present embodiment, in step S101, the row data to be transmitted is acquired and stored, the type of each data is identified, and the data and the type of each data are output when the data needs to be transmitted.

In step S102, the data type of the row data is analyzed according to the type of each data, and when the row data type meets or exceeds the preset data type criterion, an adjusting instruction is output.

In the present embodiment, in the step S102, the row data type is analyzed according to the type of each data, the acquired row data type is compared with the preset data type criterion, and an adjusting instruction is generated when the row data type meets or exceeds the preset data type criterion, so that in the subsequent steps the transmission amplitude of the output data signal can be adjusted according to the adjusting instruction. In one or more embodiments, in step S102, the row data type may be acquired by sorting and integrating the type of each data, and analyzing the data type segments with relatively regular rules. In one or more embodiments, before the step S102, the data type criterion is preset, and the row data type is compared with the preset data type criterion.

In step S103, the transmission amplitude of the output data signal is adjusted according to the adjusting instruction.

In the present embodiment, in the step S103, the transmission amplitude of the output data signal is adjusted according to the adjusting instruction, so that the transmission amplitude of each data meets the criterion, and the amplitude is not set to be too large, thus ensuring the optimal EMI radiation effect of each data; when a plurality of data are not continuously switched, the data can be transmitted by using a lower amplitude, which ensures that the EMI radiation will not exceed the criterion; meanwhile, the automatic adjustment requires less manual intervention in debugging, thereby saving time and labor. The transmission amplitude may be directly adjusted, or may be otherwise indirectly adjusted.

According to the signal adjusting method provided by the present embodiment, by identifying the type of each data, analyzing the row data type, and outputting an adjusting instruction to adjust the transmission amplitude when the row data type meets or exceeds the preset data type criterion, the method enables the transmission amplitude of each data to meet the criterion, and the amplitude is not set to be too large, thus ensuring the optimal EMI radiation effect of each data; when a plurality of data are not continuously switched, the data can be transmitted by using a lower amplitude, which ensures that the EMI radiation will not exceed the criterion; meanwhile, the automatic adjustment requires less manual intervention in debugging, thereby saving time and labor.

Figure 5:
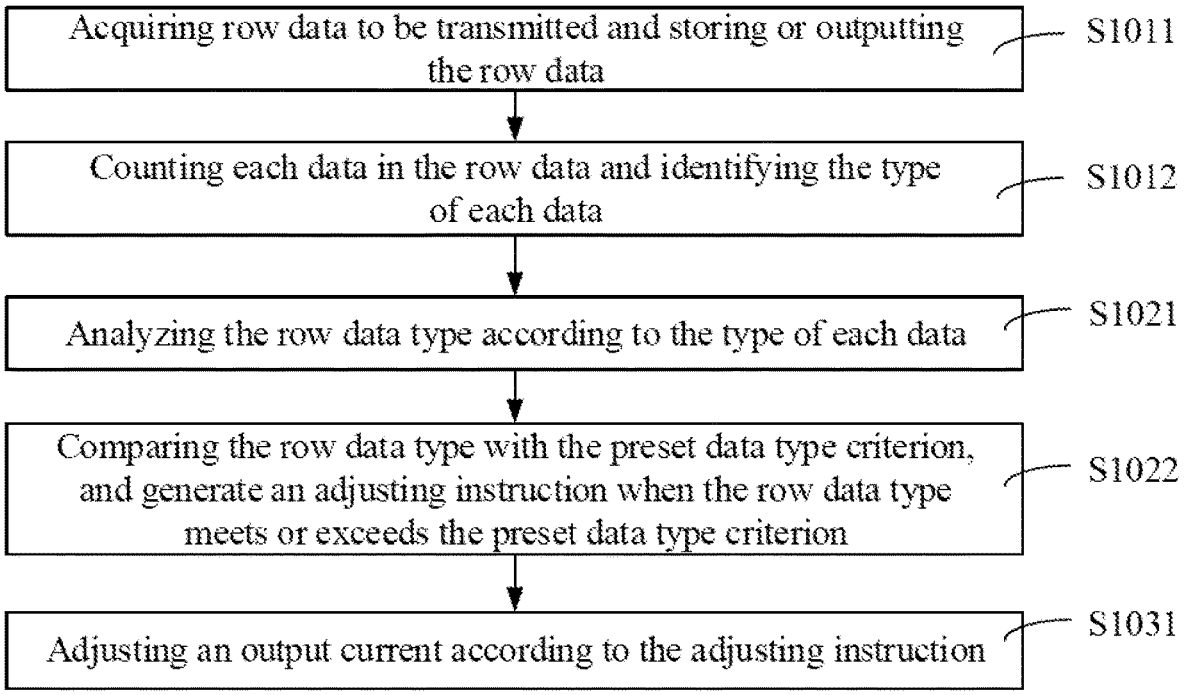
FIG. 5 is a flowchart of one of the embodiments corresponding to signal adjusting circuit of FIG. 4.

Referring to FIG. 5, which is a circuit flowchart of one of the embodiments of the signal adjusting method of FIG. 4.

In the present embodiment, step S101 includes S1011 and S1012. The sequence between S1011 and S1012 is not limited.

In step S1011, row data to be transmitted is acquired, and the row data is stored or output.

In step S1012, each data in the row data is counted, and the type of each data is identified.

In the present embodiment, step S102 includes S1021 and S1022.

In step S1021, the row data type is analyzed according to the type of each data.

In step S1022, the row data type is compared with the preset data type criterion, and an adjusting instruction is generated when the row data type meets or exceeds the preset data type criterion.

In the present embodiment, step S103 specifically is S1031.

In step S1031, the output current is adjusted according to the adjusting instruction.

According to the signal adjusting method provided by the present embodiment, by identifying the type of each data, analyzing the row data type, and generating an adjusting instruction when the row data type meets or exceeds the preset data type criterion, so that the current source can adjust the output current according to the adjusting instruction, realizing the adjustment to the transmission amplitude, enabling the transmission amplitude of each data to meet the criterion, and the amplitude is not set to be too large, thus ensuring the optimal EMI radiation effect of each data; when a plurality of data are not continuously switched, the data can be transmitted by using a lower amplitude, which ensures that the EMI radiation will not exceed the criterion; meanwhile, the automatic adjustment requires less manual intervention in debugging, thereby saving time and labor.

It should be understood that although the various steps in the flowcharts described in the above embodiments are shown in order as indicated by the arrows, the steps are not necessarily performed in order as indicated by the arrows. The steps are not limited to being performed in the exact order illustrated and, unless explicitly stated herein, may be performed in other orders. Also, at least a portion of the steps in FIGS. 4 and 5 may include multiple sub-steps or multiple stages that are not necessarily performed at the same time, but may be performed at different times, and the execution sequence of these sub-steps or stages does not need to be performed sequentially, but may be performed in turn or alternately with other steps or at least some of the sub-steps or stages of other steps.

The technical features of the above embodiments can be combined arbitrarily. For the sake of brevity, all possible combinations of the technical features of the above embodiments are not described, and such combinations of the technical features shall be deemed to fall within the scope of the present disclosure as long as there is no contradiction.

The embodiments above only describe several implementations of the present disclosure, and the description thereof is specific and detailed. However, those cannot be therefore construed as limiting the scope of the disclosure. It should be noted that, for those of ordinary skill in the art, several variations and modifications can be made without departing from the concept of the present disclosure, which also falls within the scope of the present disclosure. Therefore, the protection scope of the present application shall be defined by the appended claims.

What is claimed is:

1. A signal adjusting circuit, comprising:

an identification circuit configured to acquire a row data that comprises a plurality of bits to be transmitted on a differential pair, and further configured to identify a type of each bit, wherein the bit type comprises 0 and 1, wherein the 0 represents a negative level and the 1 represents a positive level;

an analysis circuit coupled with the identification circuit and configured to analyze a data type of the row data based on the type of each bit, and output an adjusting instruction in the case where the row data type meets or exceeds a preset data type criterion; and an adjusting circuit coupled with the analysis circuit and configured to adjust a transmission amplitude of an output data signal corresponding to the row data according to the adjusting instruction;

wherein the preset data type criterion comprises a forward preset data type criterion and a corresponding reverse preset data type criterion;

wherein the preset data type criterion is set according to a switching frequency of the data type;

wherein the differential pair comprises a first transmission line corresponding to the forward preset data type criterion and a second transmission line corresponding to the reverse preset data type criterion, and wherein when the row data type of the row data to be transmitted through the differential pair meets the preset data type criterion that the bit type is suddenly switched to 1 after a plurality of consecutive 0s or that the bit type is suddenly switched to 0 after a plurality of 1s, a transmission amplitude of each of the first transmission line and the second transmission line of the differential pair is increased.

2. The signal adjusting circuit of claim 1, wherein the identification circuit comprises:

a storage device coupled with the analysis circuit and configured to acquire the row data to be transmitted and store or output the row data; and a counting device coupled with the storage device and the analysis circuit and configured to count the plurality of bits contained in the row data and identify the type of each bit.

3. The signal adjusting circuit of claim 2, wherein the storage device comprises a row memory.

4. The signal adjusting circuit of claim 2, wherein the counting device comprises a column counter.

5. The signal adjusting circuit of claim 1, wherein the analysis circuit comprises:

an analysis device coupled with the identification circuit and configured to analyze the row data type based on the type of each bit; and a comparison device coupled with the analysis device and configured to compare the row data type against the preset data type criterion, and generate the adjusting instruction in the case where the row data type meets or exceeds the preset data type criterion.

6. The signal adjusting circuit of claim 1, wherein the adjusting circuit comprises:

a current adjusting device coupled with the analysis circuit and configured to adjust an output current according to the adjusting instruction.

7. The signal adjusting circuit of claim 6, wherein the current adjusting device is a current source.

8. The signal adjusting circuit of claim 1, wherein the row data is a pixel data.

9. The signal adjusting circuit of claim 1, wherein in the case where there are a plurality of consecutive same bits being transmitted on each of the first transmission line and the second transmission line of the differential pair, the row data is transmitted using a relatively low amplitude without adjustment on each of the first transmission line and the second transmission line of the differential pair.

10. The signal adjusting circuit of claim 1, wherein an intersection point of a sloping switching curve of a first voltage level on the first transmission line with a corresponding reversely sloping switching curve of a second voltage level on the second transmission line after the adjustment of increasing the transmission amplitude of each of the first transmission line and the second transmission line is earlier in time than an intersection point of a sloping switching curve of the first voltage level on the first transmission line with a corresponding reversely sloping switching curve of the second voltage level on the second transmission line before the adjustment.

11. A display device comprising a display panel and a signal adjusting circuit coupled with the display panel;

wherein the signal adjusting circuit comprises:

an identification circuit configured to acquire a row data that comprises a plurality of bits to be transmitted on a differential pair, and further configured to identify a type of each bit, wherein the bit type comprises 0 and 1, wherein the 0 represents a negative level and the 1 represents a positive level;

an analysis circuit coupled with the identification circuit and configured to analyze a data type of the row data based on the type of each bit, and output an adjusting instruction in the case where the row data type meets or exceeds a preset data type criterion; and an adjusting circuit coupled with the analysis circuit and configured to adjust a transmission amplitude of an output data signal corresponding to the row data according to the adjusting instruction;

wherein the preset data type criterion comprises a forward preset data type criterion and a corresponding reverse preset data type criterion;

wherein the preset data type criterion is set according to a switching frequency of the data type;

wherein the differential pair comprises a first transmission line corresponding to the forward preset data type criterion and a second transmission line corresponding to the reverse preset data type criterion, and wherein when the row data type of the row data to be transmitted through the differential pair meets the preset data type criterion that the bit type is suddenly switched to 1 after a plurality of consecutive 0s or that the bit type is suddenly switched to 0 after a plurality of 1s, a transmission amplitude of each of the first transmission line and the second transmission line of the differential pair is increased.

12. A signal adjusting method comprising:

acquiring a row data that comprises a plurality of bits to be transmitted on a differential pair, and identifying a type of each bit, wherein the bit type comprises 0 and 1, wherein the 0 represents a negative level and the 1 represents a positive level;

analyzing a data type of the row data based on the type of each bit, and outputting an adjusting instruction in the case where the row data type meets or exceeds the preset data type criterion; and adjusting a transmission amplitude of an output data signal corresponding to the row data according to the adjusting instruction;

wherein the preset data type criterion comprises a forward preset data type criterion and a corresponding reverse preset data type criterion;

wherein the preset data type criterion is set according to a switching frequency of the data type;

wherein the differential pair comprises a first transmission line corresponding to the forward preset data type criterion and a second transmission line corresponding to the reverse preset data type criterion, and wherein when the row data type of the row data to be transmitted through the differential pair meets the preset data type criterion that the bit type is suddenly switched to 1 after a plurality of consecutive 0s or that the bit type is suddenly switched to 0 after a plurality of 1s, a transmission amplitude of each of the first transmission line and the second transmission line of the differential pair is increased.

13. The signal adjusting method of claim 12, wherein the step of acquiring the row data to be transmitted and identifying the type of each bit comprises:

acquiring the row data to be transmitted and storing or outputting the row data; and counting the plurality of bits contained in the row data and identifying the type of each bit.

14. The signal adjusting method of claim 12, wherein the step of analyzing the data type of the row data based on the type of each bit and outputting the adjusting instruction in the case where the data type meets or exceeds the preset data type criterion comprises:

analyzing the row data type based on the type of each bit; and comparing the row data type against the preset data type criterion, and generate the adjusting instruction in the case where the row data type meets or exceeds the preset data type criterion.

15. The signal adjusting method according to claim 12, wherein the step of adjusting the transmission amplitude of the output data signal corresponding to the row data according to the adjusting instruction specifically comprises:

adjusting an output current according to the adjusting instruction.

16. The signal adjusting circuit of claim 1, wherein the preset data type criterion is that the bit type is suddenly switched to 1 after a plurality of consecutive 0s or that the bit type is suddenly switched to 0 after a plurality of consecutive 1s.

17. The signal adjusting circuit of claim 16, wherein the plurality is 3, and accordingly the forward preset data type criterion is 11101110 and the reverse preset data type criterion is 00010001.

* * * * *